US007619176B2

(12) United States Patent
Yoshihiro

(10) Patent No.: US 7,619,176 B2
(45) Date of Patent: Nov. 17, 2009

(54) SWITCH AND ELECTRONIC EQUIPMENT HAVING THE SAME

(75) Inventor: Takaaki Yoshihiro, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 12/279,163

(22) PCT Filed: Feb. 13, 2007

(86) PCT No.: PCT/JP2007/052903

§ 371 (c)(1),
(2), (4) Date: Aug. 12, 2008

(87) PCT Pub. No.: WO2007/094483

PCT Pub. Date: Aug. 23, 2007

(65) Prior Publication Data

US 2009/0026057 A1 Jan. 29, 2009

(30) Foreign Application Priority Data

Feb. 13, 2006 (JP) ..... 2006-035778

(51) Int. Cl.
*H01H 13/715* (2006.01)

(52) U.S. Cl. ..... 200/516; 200/406

(58) Field of Classification Search ..... 200/5 A, 200/406, 512–517, 341; 341/22; 345/156, 345/168, 169

See application file for complete search history.

(56) References Cited

U.S. PATENT DOCUMENTS 4,065,651 A * 12/1977 Erni et al. ..... 200/5 A
4,086,451 A * 4/1978 Boulanger ..... 200/5 A
4,245,138 A * 1/1981 Harper ..... 200/5 A
4,771,143 A * 9/1988 Hoffmann ..... 200/512
5,172,114 A * 12/1992 Bedoya et al. ..... 341/27
5,950,808 A * 9/1999 Tanabe et al. ..... 200/314
6,018,132 A * 1/2000 Chen ..... 200/406
6,639,165 B1 * 10/2003 Newman et al. ..... 200/83 Y
6,806,815 B1 * 10/2004 Kaikuranta et al. ..... 341/22
7,019,242 B2 * 3/2006 Kim ..... 200/514
7,094,985 B2 * 8/2006 Kobayashi et al. ..... 200/516

FOREIGN PATENT DOCUMENTS

JP 1-221824 A 9/1989
JP 2004-96057 A 3/2004

* cited by examiner

*Primary Examiner*—Michael A Friedhofer
(74) *Attorney, Agent, or Firm*—Sughrue Mion, PLLC

(57) ABSTRACT

A switch according to the present invention has a plurality of protruding parts and a plurality of support sections both of which are formed on a surface of a thin metal sheet by press molding. The switch includes a plurality of switch sections formed by elastic deformable conductors arranged so as to have a convex surface opposed to the protruding parts, a wiring sheet covering the conductors, and switch buttons. At least one support portion is provided around the protruding parts and a gap area is left between the protruding parts and a switch sheet. In this gap area, each conductor is accommodated at the same position as the protruding parts. The support sections are disposed in a dotted-form to accomplish improvement of a feeling of click that is one of the performances on which the user places much value. In addition, a casing, the protruding parts, and the support portions are press-molded of a thin metal sheet, thereby obtaining the effect of reducing wall thickness and increasing the rigidity.

9 Claims, 8 Drawing Sheets

SWITCH AND ELECTRONIC EQUIPMENT HAVING THE SAME

TECHNICAL FIELD

The present invention relates to a casing structure for accommodating functional components of a small mobile terminal and a switch having the same, and more particularly, to a switch structure helping to achieve an improved feeling of click.

BACKGROUND ART

In a mobile terminal such as a mobile phone, a personal handy phone system (PHS), and a personal digital assistant (PDA), a tendency toward downsizing and thinning is being accelerated. In order to achieve the downsizing and thinning of such mobile terminals described above, development has been advanced about downsizing and thinning of functional components for forming the same, thinning of a printed circuit board on which the functional components are mounted, downsizing of an antenna system, a reduction in wall thickness and thinning of a casing accommodating the functional components, the printed circuit board, etc., and the like.

FIG. 8 is a sectional view of the switch section of a conventional mobile terminal. The structure shown in FIG. 8 might be similar to an elastically deformable switch dome (conductor) that is illustrated by 524 in Patent Document 1 (JP 2004-96057 A) and that is reversed upside down. A conductor 124 is arranged so that the conductor 124 is covered with a cover sheet 102B along a recess 111 provided in a casing 127 and is fixed with the cover sheet 102B. A switch button sheet 102A is arranged over the conductor 124, and a switch button 125 and a top plate 106 are arranged over the switch button sheet 102A. The conductor 124 and a protruding part 112 are situated in the recess 111.

When the switch button 125 is depressed, a periphery of the switch button 125 pushes down an entire contour of the conductor 124, with the periphery of the switch button 125 supported by the supported sections 113, and as a result, a click operation is performed due to the protruding part 112, whereby the switch circuit is operated. In an example shown in the figure, the casing 127 is to be produced by molding.

The structure is characterized in that the supporting sections 113 are arranged around a plurality of the protruding parts 112 so as to provide a single plane. That is, the peripheries of the supporting sections 113 are continuous with each other on the same plane. Thus, the support area for the switch sheet has a wide area.

DISCLOSURE OF THE INVENTION

Problem to be Solved by the Invention

Owing to a structure in which the supporting sections are arranged in a single plane, the casing and the switch structure of the configuration as disclosed in Patent Document 1 have a problem in that the support surface becomes wide, resulting in a poor feeling of click.

It is an object of the present invention to provide a casing structure and a switch structure therefor helping to achieve an improved feeling of click in the switch of a mobile terminal and making it possible to achieve further thinning.

Means to Solve the Problem

A switch of the present invention includes: a wiring sheet having wiring on a surface thereof; an elastic member electrically conductive to the wiring of the wiring sheet; and a structure equipped with a plurality of supporting sections for supporting the wiring sheet, and is characterized in that the supporting sections are arranged so as to accommodate the elastic member between the supporting sections, with a distance (inner dimension) between the supporting sections being larger than a width of the elastic member.

Further, a switch of the present invention is characterized in that an electrode is formed on the wiring sheet, and the electrode is situated so as to be in contact with the elastic member at the time of deformation of the elastic member.

Further, a switch of the present invention is characterized by including a space formed so as to be capable of accommodating the elastic member by the plurality of supporting sections, and is characterized in that a protruding part is formed on a structure forming the space.

Further, a switch of the present invention is characterized in that the elastic member is held between the wiring sheet and a cover sheet.

Further, a switch of the present invention is characterized by including a switch button arranged on a back surface of the wiring sheet.

Further, a switch of the present invention is characterized by including a top plate provided on a back surface side of the wiring sheet and covering the wiring sheet.

Further, a switch of the present invention is characterized in that the structure is a casing.

Further, a switch of the present invention is characterized in that the casing is formed of a sheet metal.

Further, according to the present invention, an electronic device including the switch described above is provided.

Effect Of The Invention

In the switch of the present invention, the supporting sections provided on the structure are arranged so as to accommodate the elastic member between the supporting sections, and the distance between the supporting sections is larger than the width of the elastic member, whereby it is possible to achieve an improvement in terms of click feel.

BEST MODE FOR CARRYING OUT THE INVENTION

Next, description is made in detail about an embodiment of the present invention with reference to the drawings.

Figure 1:
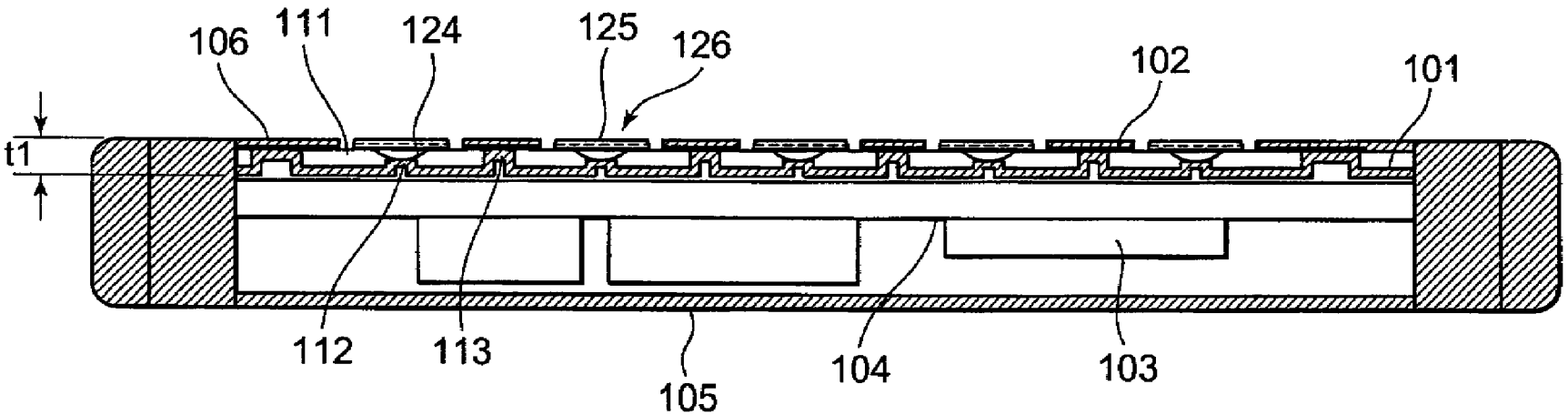
FIG. 1 is a sectional view of an electronic device showing a switch according to a first embodiment of the present invention.
Figure 2:
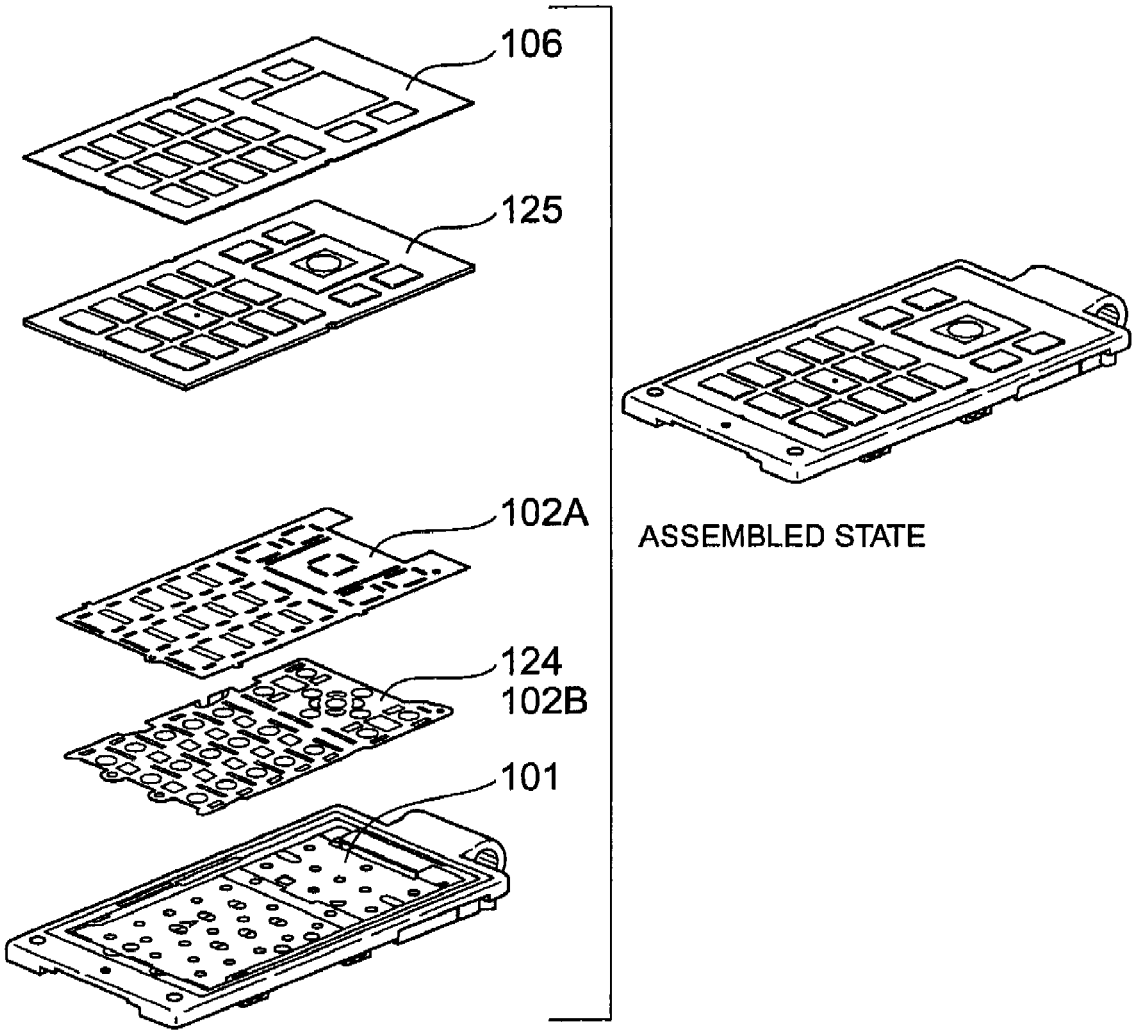
FIG. 2 is an exploded perspective view of the switch according to the first embodiment of the present invention.
Figure 3:
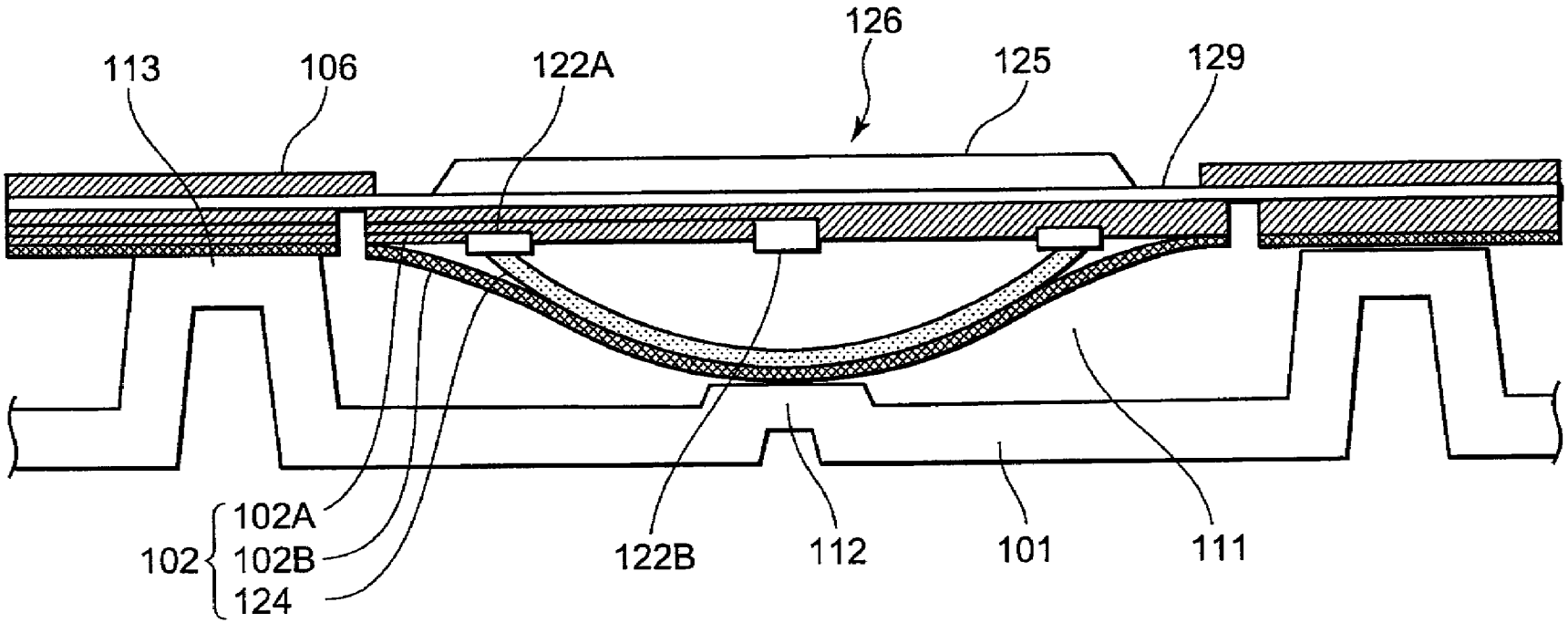
FIG. 3 is a sectional view of the switch according to the first embodiment of the present invention.

FIG. 1 is a sectional view of a switch according to an embodiment of the present invention. FIG. 2 is an exploded perspective view of the switch, and FIG. 3 is a sectional view of a single switch unit.

As shown in FIGS. 1 and 2, the switch according to the present invention has a plurality of protruding parts 112 and a plurality of supporting sections 113 both of which are formed on a surface of a thin metal sheet through press molding. A plurality of switch sections are formed by elastically deformable dome-shaped conductors 124 arranged such that the convex surfaces thereof are opposed to the protruding parts 112, a wiring sheet 102A covering the conductors 124, and switch buttons 125.

At least two supporting sections 113 are provided around each protruding part 112, and the supporting sections 113 are arranged so that the conductor 124 of an elastic material can be accommodated between one supporting section 113 and another supporting section 113. That is, the horizontal distance between the supporting sections 113, 113' is larger than the width of the conductor 124 formed of an elastic member in both the longitudinal and lateral directions.

Further, there is provided a space 111 formed among the supporting sections 113, the protruding parts 112, and the switch sheet 102, and the conductors 124 are accommodated in the space 111. Inside the case main body 101, there is arranged a substrate 104 on which an electronic component 103 is mounted and which is equipped with wiring.

As is best shown in FIG. 3, which is a sectional view of the switch section of FIG. 1, the key sheet 129 is arranged on the wiring sheet 102A. The switch button 125 is fixed to the key sheet 129, and there is provided a top plate 106 which surrounds the switch buttons 125 and which is arranged on the key sheet 129. The top plate 106 has a size somewhat larger than the contour of the key sheet 129, and is arranged so as to cover the components below.

Here, the protruding parts 112 are protruding portions formed by performing press working on a metal sheet, and are used to perform click operation by denting the convex portions of the conductors 124.

The supporting sections 113 are arranged around each switch button 125. When, at the time of depression of the switch button 125, the periphery of the switch button 125 is depressed, the supporting sections function to suppress malfunction due to depression of other switch buttons 125 in the periphery. Another function of the supporting sections 113 is to maintain the flatness of the portion of the top plate 106 around the switch buttons 125 and to secure the rigidity thereof. For example, even when the switch buttons 125 are depressed and a finger crosses over each switch button 125 to an adjacent switch region, it is possible to keep such an adjacent switch region flat and to maintain a sense of the requisite rigidity.

Further, as shown in FIG. 3, the switch sheet 102 is a composite sheet formed by stacking the wiring sheet 102A, the conductors 124, the cover sheet 102B, etc together. The switch buttons 125 are mounted on top of the switch sheet 102. The conductors 124 are held by the cover sheet 102B which partially or entirely exhibits adhesiveness, and are substantially arranged at the same positions as the wiring patterns 122A and 122B of the wiring sheet 102A such that the convex portions of the conductors 124 are directed toward the protruding parts 112. Further, the conductors 124 are held by the cover sheet 102B so that the positional relationship with the wiring patterns 122A and 122B and the conductors 124 is kept unmoved in the horizontal direction.

A plurality of conductors 124 of elastic members are provided on the wiring sheet 102A to establish a switch function for each switch button 125. The elastic members for forming the conductors 124 may be elastically deformable and may be kept electrically conductive between the wiring patterns 122A and 112B on elastic deformation. For example, the conductors 124 may be entirely formed of a conductor, or the conductors 124 may have electrically conductive portions partially formed on an elastic deformable base member to provide electrical conduction between the wiring patterns 122A and 122B. The conductors 124 may be provided by elastic members for keeping electrical conduction between the wiring patterns 122A and 122B when the switch buttons 125 are depressed to elastically deform the conductors 124.

The wiring sheet 102A forming the switch sheet 102 is a flexible printed circuit (FPC) sheet, and has the wiring patterns (electrodes) 122A and 122B on the surface opposite to the surface where the switch buttons 125 are arranged. The wiring patterns 122A and 122B are electrically connected to the electronic component 103 on the substrate 104 of FIG. 1. Further, the wiring patterns 122A are formed around the wiring patterns 122B in an annular shape. Here, the wiring patterns 122A may be partially cut out so as to form lead-out wiring patterns for guiding the wiring patterns 122B outside of the formation areas of the wiring patterns 122A. Further, the wiring patterns 122B may not always be a wiring pattern but may be an electrode for providing conduction for an electric signal.

The conductors 124 have the outer peripheral portions contacted with the wiring patterns 122A with the pressing force given from the cover sheet 102B. Thus, the conductors 124 are in contact with the wiring patterns 122A and, as a result, the conductors 124 and the wiring patterns 122A are electrically connected to each other.

Here, the distance between the wiring patterns 122B and the upper surfaces of the convex portions of the conductors 124 is approximately 0.2 mm and this distance is sufficiently smaller than the diameter of the wiring patterns 122A. Further, the wiring sheet 102A and the cover sheet 102B are formed of elastic sheets.

It is also possible for the wiring patterns 122A and 122B to partially use electrodes for wiring. At any rate, the elastic body electrically connected to the wiring patterns 122A may be electrically connected to the wiring pattern 122B when the switch button 125 is depressed.

Here, the configurations, dimensions, and layout of the supporting sections 113 and the protruding parts 112 are described. As represented by the 2 switch button 125''' of FIG. 5, in the basic construction of the portion around each switch button 125, a plate for providing the switch button 125 is in one-to-one correspondence with one switch function. In this case, the supporting sections 113 are arranged at the four corners of the switch button 125'''. The upper surfaces of the supporting sections 113 may be selected in configuration from circular, elliptical, and polygonal shapes and are shaped into the circular and elliptical configurations in this example. The end surfaces of the upper surfaces of the supporting sections 113 have rounded configurations of a predetermined curvature.

The protruding parts 112 are of a circular shape, and their upper end surfaces are of a predetermined rounded configuration. Gaps are provided between the contours of the protruding parts 112 and the contours of the switch buttons 125 so that they may not overlap each other at least in one direction in plan view. In the example shown, the contours of the switch buttons 125 are formed to be larger than the contours of the protruding parts 112. As a result, the switch buttons 125 have portions not opposed to the protruding parts 112, that is, they have gaps. A reduction in gaps brings about deterioration of the feeling of click. Further, the gap degree is directly related to the interval between the switch buttons, and hence it has an influence on the design property.

Thus, the dimensions and the layout of the supporting sections 113 and the protruding parts 112 are determined in consideration of the characteristics of the materials used and the design. The diameter and the height of the protruding parts 112 influence the click characteristic of the conductors 124. Usually, the diameter of the protruding parts 112 is preferably approximately 20% to 50% of the diameter of the conductors 124. For example, in the case of conductors 124 of a diameter ø of 4 mm, each diameter ø of the protruding parts 112 preferably falls within a range from 1.5 to 2.0 mm, and the height thereof preferably ranges from 0.2 to 0.3 mm.

On the other hand, the height of the supporting sections 113 are set to a height somewhat higher than the height of the protruding parts 112. When the area of the supporting sections 113 is too large as compared with the area of the periphery of the protruding parts 112, or when the supporting sections 113 are too close to the protruding parts 112, or when the difference in height between the supporting sections 113 and the protruding parts 112 is too large, a feeling of click may be deteriorated. Further, if the protruding parts 112 are higher than the supporting sections 113, malfunctions of the peripheral switch buttons and deflection of the peripheral portion will be caused to occur. In view of this, regarding the layout and configuration of the supporting sections 113, it is preferable that the size, the thickness, the material, a laminated structure, and the like would be optimized about the members constituting the switch section 126, that is, in this construction, about the cover sheet 102B, the wiring sheet 102A, the conductors 124, the top cover 106, and the switch section 126.

Figure 6:
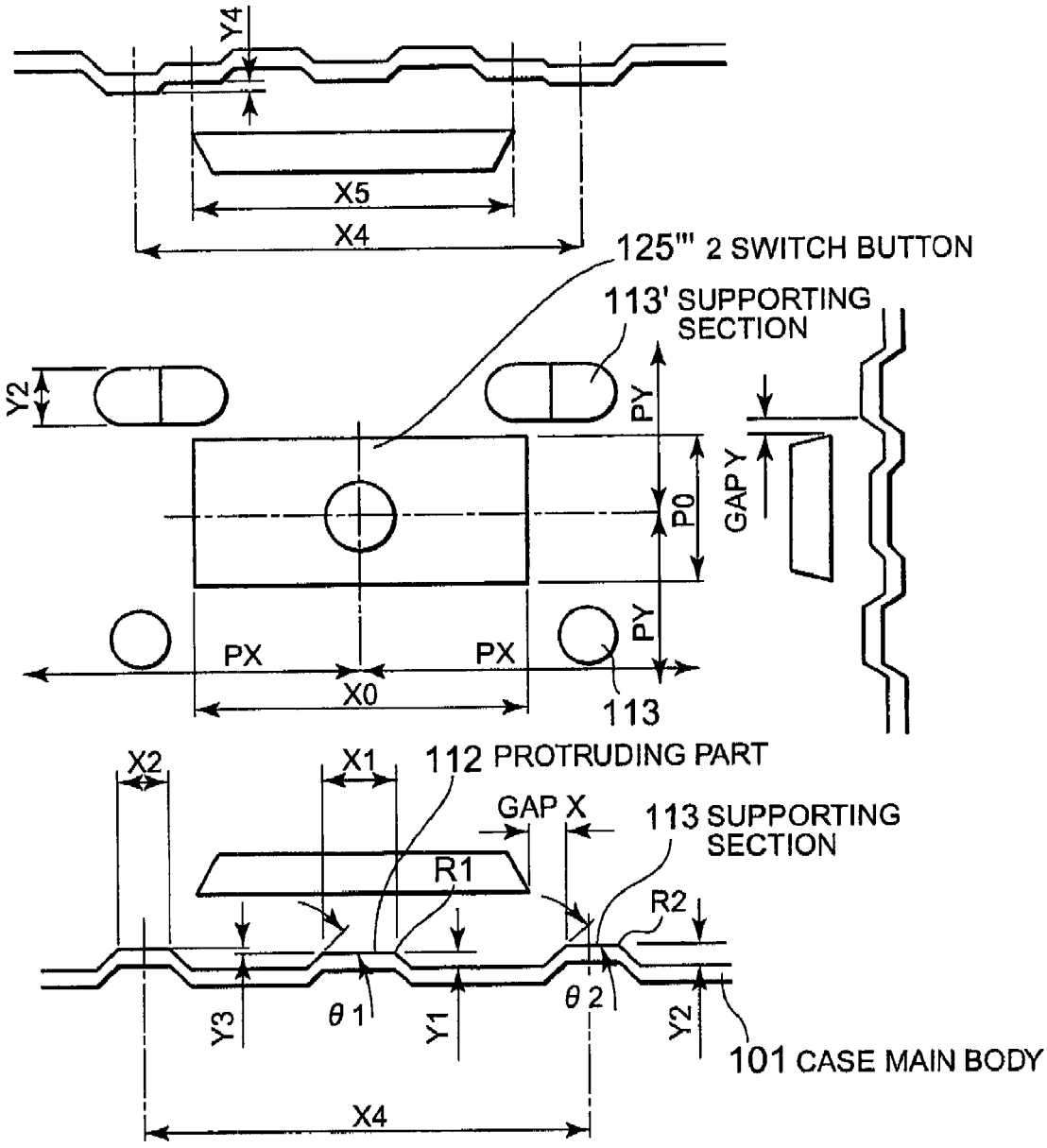
FIG. 6 is a dimensional diagram showing the switch section of the switch according to the first embodiment of the present invention.
Figure 7:
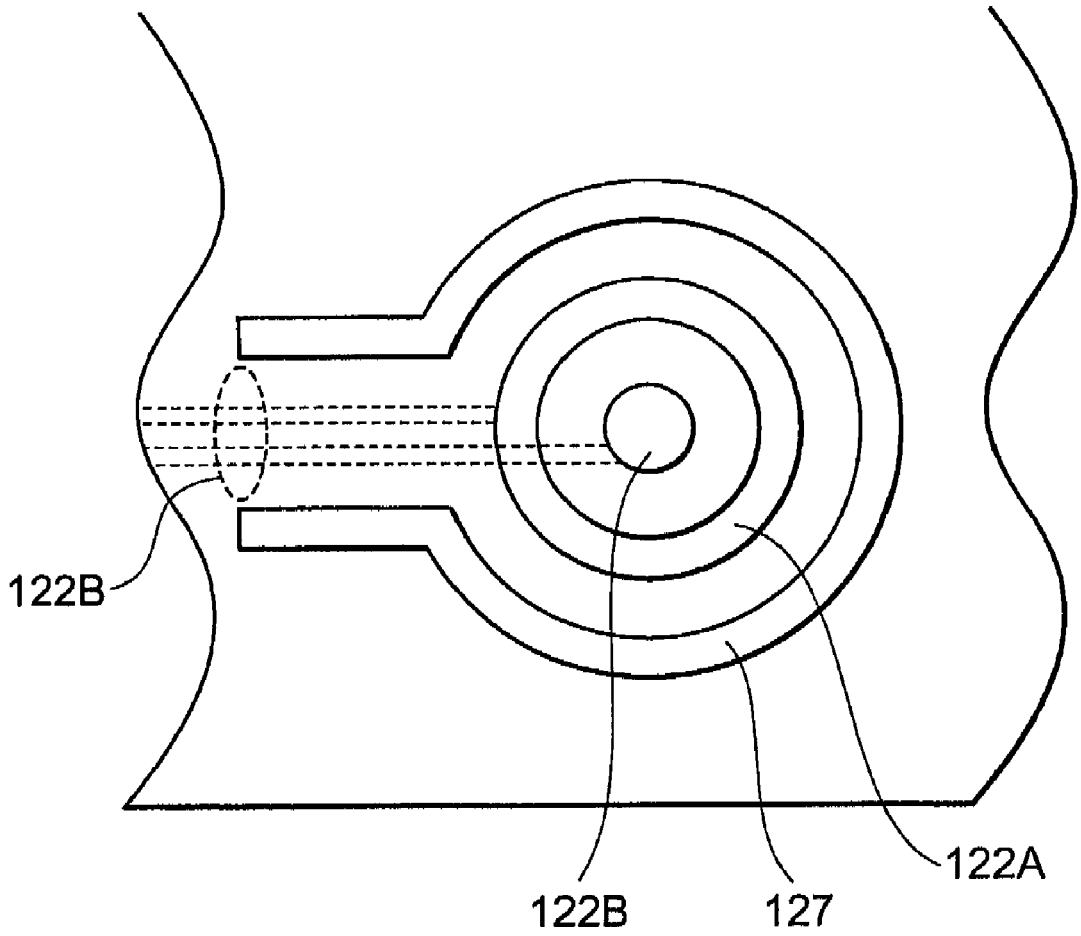
FIG. 7 is a plan view of a stamping portion of a wiring sheet and a cover sheet of a switch according to the present invention.
Figure 8:
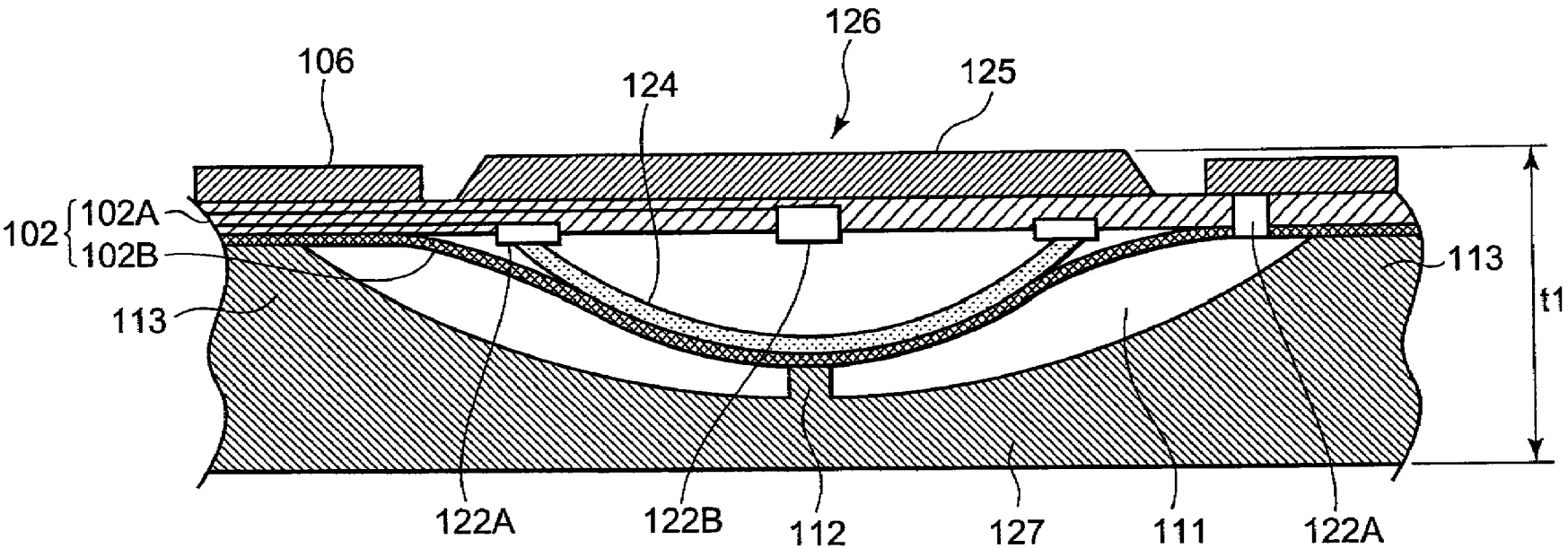
FIG. 8 is a sectional view of a conventional thin switch structure.

More specifically, the layout and the dimensional relationship are exemplified in FIG. 6. An example of the configuration, dimension, and layout of the protruding parts 112 and the supporting sections 113 is explained on the assumption that the outer diameter a of 4 mm and an operational force of 1.3N of the single conductor 124 are determined by the specifications. In FIG. 6, it is assumed that the 2 switch button 125''' has a lateral width X0 of 9.5 mm, a longitudinal width Y0 of 5 mm, a lateral directional pitch PX of 12.5 mm, and a longitudinal directional pitch PY of 7.5 mm. The supporting sections 113 are arranged at four corners of the switch button 125. More specifically, there are arranged two columnar supporting sections 113 on the lower right-hand and left-hand sides of FIG. 6, and two elliptical supporting sections 113' on the upper right-hand and left-hand sides thereof.

The upper surface diameter X1 of the illustrated protruding part 112 is set to ø1.5 mm, and the upper surface diameter X2 of the illustrated supporting section 113 and the longitudinal width Y2 of the supporting section 113' are set to 1.35 mm. Further, the upper end surface dimension R2 of the supporting sections 113 is 0.3 mm, and the upper end surface dimension R1 of the protruding parts 112 is 0.3 mm. That is, they are shaped into a rounded configuration matched with the configuration formed when the switch buttons 125 and the conductors 124 are deflected. At all events, as shown in the figure, the horizontal distance (inner dimension) between the supporting sections 113, 113' is larger than the width of the conductors 124 formed of an elastic material in both the longitudinal and lateral directions. This serves as a factor of improving the click characteristic.

The height Y2 of the circular supporting sections 113 and that of the elliptical supporting sections 113' are both 0.35 mm while the height of the protruding parts 112 is 0.3 mm, and the difference in height between the supporting sections 113 and the protruding parts 112 is equal to 0.05 mm. The height of the supporting sections 113' is the same as that of the supporting sections 113, and there is provided a laterally adjacent step Y4, whose dimension is 0.08 mm. In this dimensional relationship, the lateral gap X of the switch button 125 and the supporting sections 113 is approximately 0.8 mm, and the longitudinal gap Y thereof is 0.6 mm. The feeling of click is greatly influenced by the gap X, the gap Y, the protruding part height Y1, the supporting section height Y2, the step Y3 of the difference in height between the protruding parts 112 and the supporting sections 113, and the configuration of the upper surfaces of the supporting sections 113. The above-mentioned dimensional relationship is effective to an example for providing a satisfactory feeling of click. Apart from this, an adjustment is also made on the kind and thickness of the constituent material, the gluing material, and the gluing area. Regarding the above-mentioned dimensional relationship, it is possible to obtain an optimum value through the design based on the arrangement of the switch buttons 125 and a combination of the material and thickness of each member. Thus, the above-mentioned values should not be construed restrictively.

The above-mentioned structure is covered with a back casing 105 (in FIG. 1) so that the electronic component 103 and the substrate 104 may not be exposed to the exterior. When the electronic component 103 and the substrate 104 are protected electrically and mechanically by some protective member, the back casing 105 may be omitted.

Next, the switch operation is described. When the user depresses the switch buttons 125, the wiring sheet 102 and the cover sheet 102B undergo elastic deformation, and the wiring patterns 122B are pushed down. At this time, the convex portions of the conductors 124 are pushed upwardly by the protruding parts 112, and are brought into contact with the wiring patterns 122B in the vertical direction. As a result, the wiring patterns 122A and 122B become electrically continuous with each other via the conductors 124, and information indicative of the depression of the switch is input to the electronic component 103 on the substrate through the circuit as represented by that shown in FIG. 6. Here, it is not necessary for the conductors 124 to be constantly in contact with the wiring patterns. When electrical conduction is accomplished by depression of the switch buttons, electrical contact may be performed between the wiring patterns 122A and the outer peripheries of the conductors and between the wiring patterns 122B and the inner peripheries of the conductors 124.

Figure 9:
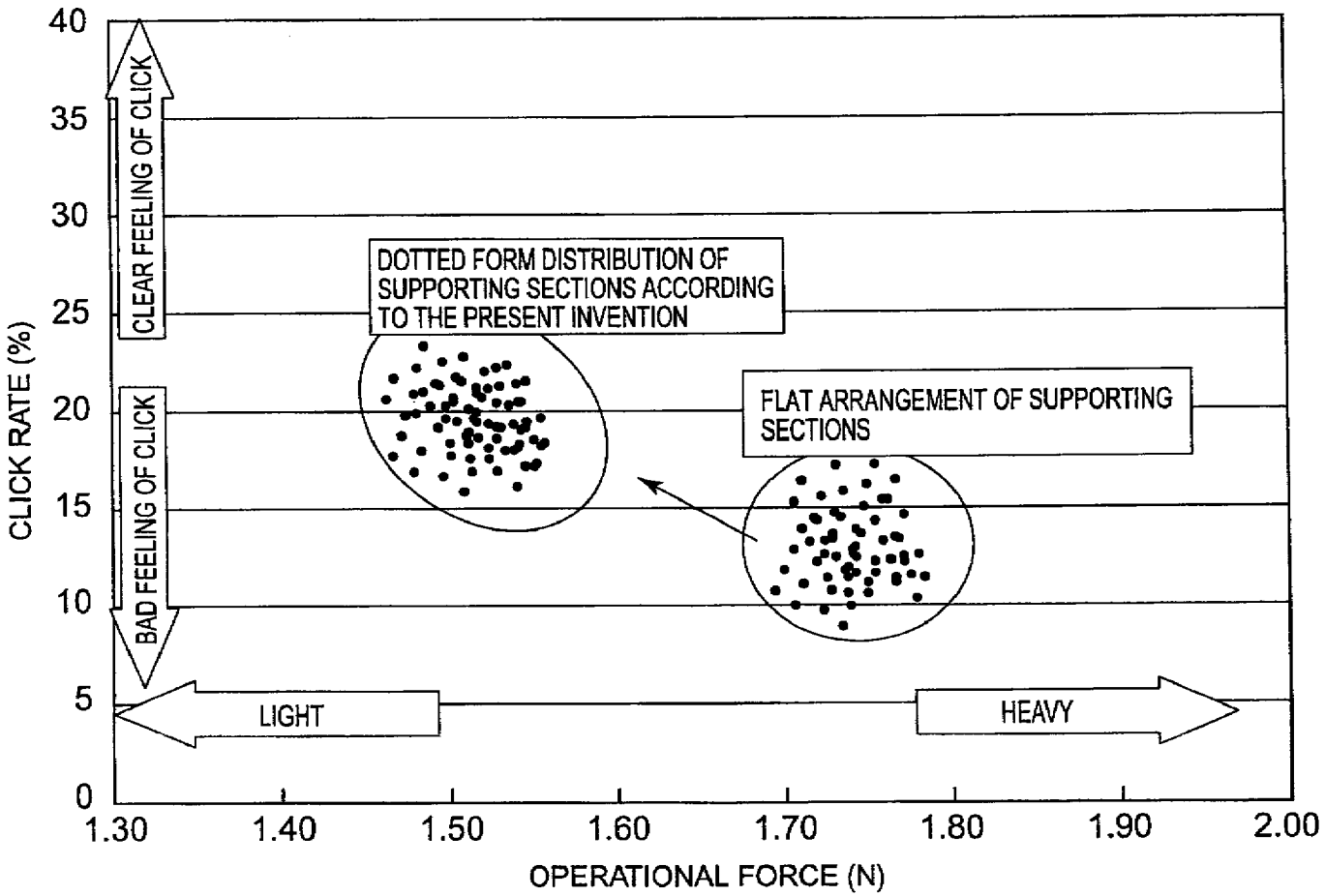
FIG. 9 is a graph showing the degree of an improvement of a sense of click.

FIG. 9 shows the effect obtained when the supporting sections of the present invention are arranged in a dotted form. As values indicating the feeling of click, there are mainly click rate and operational force. In particular, the click rate is regarded as important, and as the value thereof becomes larger, the feeling of click at the time of clicking becomes clearer. In the example shown, in which the operational force of the single conductor 124 is 1.3 N, the click rate ranges from 10 to 15%, and the operational force ranges from approximately 1.7 to 1.8 N in the conventional supporting section structure in which the supporting sections are arranged in a single plane.

In contrast, in the structure of the present invention, in which the supporting sections 113 are arranged in a dotted or spread form, the click rate is improved to approximately 20%, and the operational force is reduced to approximately 1.5 N, thereby achieving an improvement in the feeling of click. These values undergo some changes according to the material used, thickness, etc. However, it is apparent that the feeling of click is improved. Further, as stated above, at the depression of any switch button 125, the supporting sections 113 also function to suppress malfunction of the peripheral switch buttons 125. Further, it is also possible to maintain the requisite flatness of the portion of the top plate 106 around the switch buttons 125 and to secure the requisite rigidity.

Not only does the case main body 101 accommodate the substrate 104 on which the electronic component 103 is mounted, but also functions as a base for supporting the pressing force for the switch buttons 125, receiving the force generated when the user depresses the switch buttons 125. More specifically, the casing of the present invention is produced through press molding of a thin metal sheet using a mold, forming the case main body 101, the protruding parts 112, and the supporting sections 113 integrally.

Here, the metal sheet case main body 101 is used as the base of the switch section. However, in the outer peripheral area of the switch section, the metal sheet casing may be installed in the mold, and filling with resin is effected, thereby performing integral molding within the mold. Alternatively, it is also possible to obtain a required configuration by joining the components together through adhesion or bonding.

Figure 4:
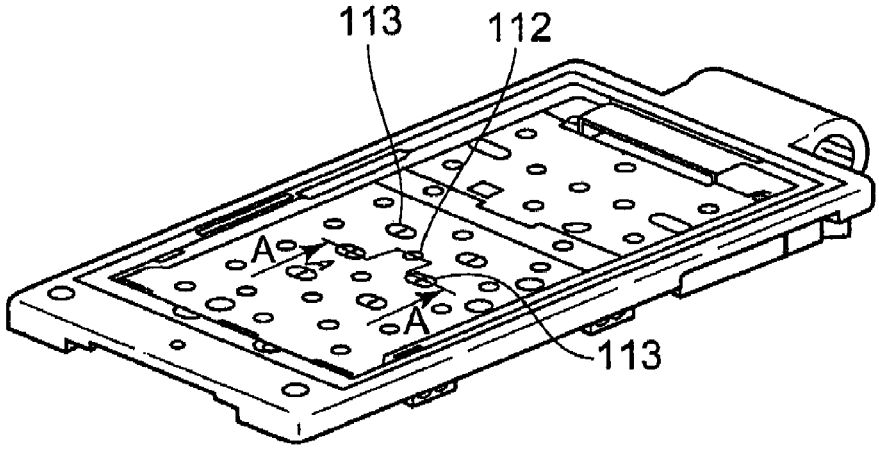
FIG. 4 is a perspective view of a case main body of the switch according to the first embodiment of the present invention.

In the casing shown in FIGS. 2 and 4, integral resin molding is performed on the portion corresponding to the outer periphery of the metal sheet casing. The configuration of the resin portion formed in the outer periphery serves to maintain the configuration for positioning the switch section and the inner components, and to complementarily strengthen the casing.

In recent years, thinning of mobile terminals brings about a tendency of reducing their components in thickness. However, the casing should have a function of protecting the inner electronic components without deformation of the casing itself. Thus, there is a limit about thinning the casing. Further, in the molding production method, flow of the molten material becomes bad. For example, when magnesium or aluminum is used as a molding material like in a conventional method, flow property of the material becomes poor and a mass production becomes difficult with a stable quality kept when the thin-walled portions of the protruding part of each lower portion are molded in a thickness of approximately 0.3 mm. In order to realize a desired quality through a stabilized material flow, a wall thickness of approximately 0.4 to 0.45 mm is the limit at the protruding part lower portions where the wall thickness is minimum.

In the present invention, the casing is reduced in thickness, and the regions requiring rigidity and switch function are formed by a metal sheet while the regions requiring complicated configuration are formed by resin. According to this structure, it is possible to suppress a reduction in bending rigidity and torsional rigidity of the casing is suppressed, making it possible to prevent deformation and damage of the constituent components. Further, by integrally molding the protruding parts 112 and the supporting sections 113 with the case main body 101, it is possible to achieve thinning as compared with the case in which the protruding parts 112 or the supporting sections 113 are formed as separate components in the form of dedicated sheets. Further, by forming the case main body by a metal sheet of stainless steel, aluminum, magnesium, titanium alloy or the like, the casing structure of the present invention exhibits sufficient rigidity, and maintains a predetermined requisite configuration if an external force such as switch operation, etc. by the user is applied thereto. Further, due to the above-mentioned rigidity, deflection of the casing can be suppressed to a minimum at the time of switch depression, and hence it is possible to obtain a clear feeling of click. As described above, by integrally molding the protruding parts 112 and the supporting sections 113 through press molding of a thin metal sheet, thinning of the casing is possible. More specifically, compared with a case where the casing thickness is 0.4 to 0.45 mm in the case of the conventional molding production method, formation is possible with a thin metal plate having a thickness of 0.3 mm, and hence thinning by 0.1 to 0.15 mm is possible.

Further, by integrally molding the protruding parts 112 and the supporting parts with the casing configuration, it is possible to achieve a reduction in number of components which were conventionally formed by separate components and a reduction in production cost.

Further, the deformation amount of the substrate 104 accommodated in the case main body 101 can be minimized, making it also possible to suppress separation of the solder of the electronic component 103 mounted on the substrate 104 and to suppress damage of the wiring. Further, in this casing structure, the protruding parts 112 and the supporting sections 113 are formed by press molding, whereby it is possible to generate a space on the side opposite to the protruding side, and heat generated by the electronic component 103 and the substrate 104 arranged inside the casing are heat-insulated by the air layer, suppressing an excessive increase in the temperature of the switch section surface touched by the user.

Figure 5:
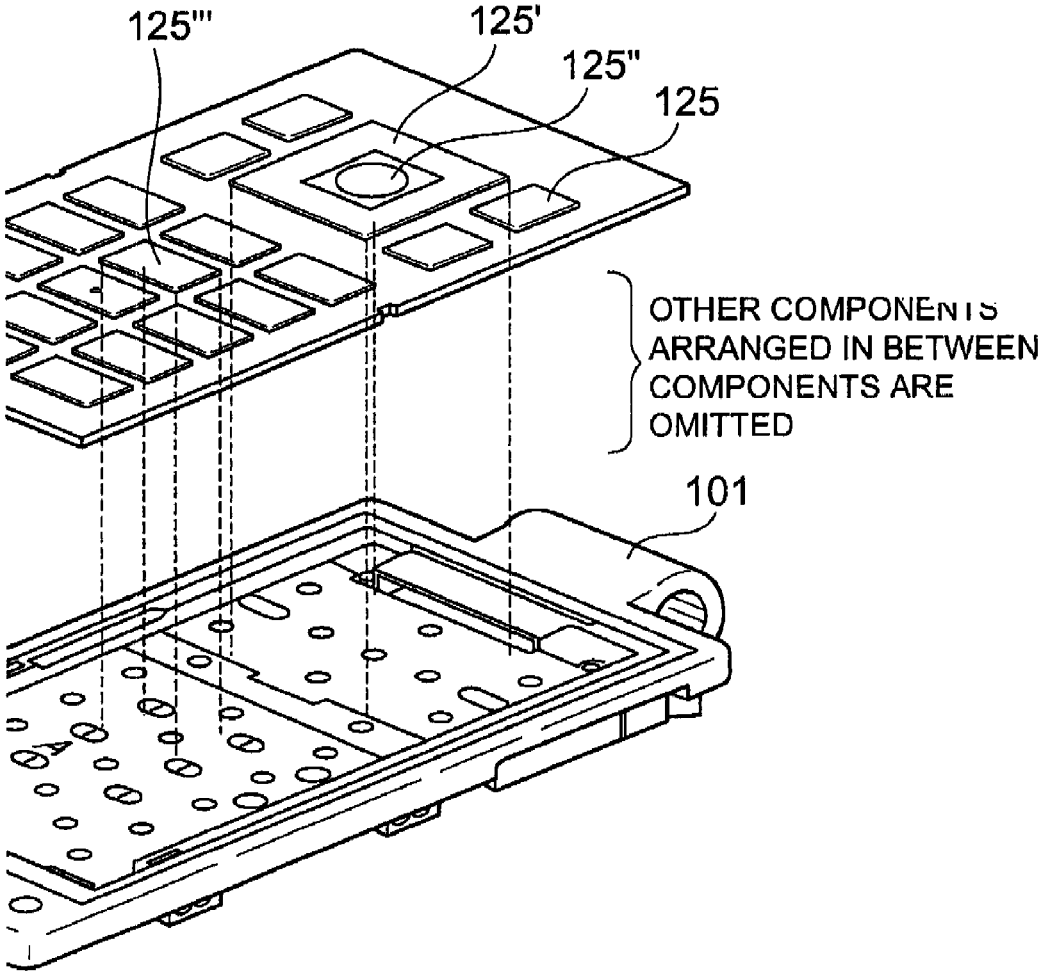
FIG. 5 is a perspective view of a switch according to the first and second embodiments of the present invention.

FIG. 5 also shows a perspective view of the second embodiment of the present invention, in which the portion around the four-direction switch button is illustrated. In the first embodiment described above, the plate constituting the switch button is in one-to-one correspondence with a switch function. On the other hand, the second embodiment differs from the first embodiment in the arrangement of the support sections constituted when the plate of the switch button has a plurality of switch functions. The four-way switch button 125' shown in the figure has four switch functions assigned to the four sides of its rectangular configuration. One supporting section is provided for each of the right and left-hand side switch functions. In this case, two or more peripheral supporting sections are arranged for a single plate constituting the switch button. More specifically, there are arranged rectangular supporting sections 113 on the upper and lower, and right-hand and left-hand sides of each switch button 125. Further, the supporting sections 113 also serve as the supporting sections of the adjacent switch button 125. As a result, there is no need to arrange supporting sections in the region that becomes narrow due to the presence of the peripheral protruding parts 112 and supporting sections 113. In the press molding of a metal sheet, as more protruding objects exist in a small region, the moldability becomes poorer, resulting in deterioration in flatness and the dimensional precision of the protruding objects. In this way, it is possible to obtain the effect of suppressing deterioration in moldability and a feeling of click.

Further, it is also possible to form the protruding parts 112 and the supporting sections 113 of some other material on the metal sheet. For example, it is also possible to bond metal pieces, resin material or the like by caulking or adhesion. In this case, the heat insulation effect due to press molding and space formation is reduced, and the number of components increases. However, the complicated configuration in press molding is mitigated, which is advantageous in manufacturing from the viewpoint of attaining high precision in flatness.

While this embodiment has been described with reference to a casing, there is no limitation as long as it is a structure, and any other structure will do, for example, one that can be mounted within the casing. For example, it may be a part of a frame accommodated in a casing, or a part of a printed circuit board. Further, while in this embodiment the casing includes a metal sheet and a resin portion constituting an exterior portion and being formed of a resin, the resin portion may be formed only when it is needed. Thus, the switch of the present invention may have a structure corresponding to the casing formed by a metal sheet.

INDUSTRIAL APPLICABILITY

The present invention is applicable not only to a mobile phone but also to other mobile terminals such as a PDA and an electronic device such as a personal computer.

The invention claimed is:

1. A switch comprising:

a wiring sheet having wiring on a surface thereof;

an elastic member electrically conductive to the wiring of the wiring sheet; and a structure equipped with a plurality of supporting sections for supporting the wiring sheet, wherein the supporting sections are arranged so as to accommodate the elastic member between the supporting sections and a distance between the supporting sections is larger than a width of the elastic member.

2. A switch according to claim 1, wherein the wiring sheet has an electrode and wherein the electrode is situated so as to be in contact with the elastic member at the time of deformation of the elastic member.

3. A switch according to claim 1, further comprising a space in which the elastic member is accommodated by the plurality of supporting sections and wherein a protruding part is formed on a structure forming the space.

4. A switch according to claim 1, wherein the elastic member is held between the wiring sheet and a cover sheet.

5. A switch according to claim 1, further comprising a switch button arranged on a back surface of the wiring sheet.

6. A switch according to claim 1, further comprising a top plate provided on a back surface side of the wiring sheet and covering the wiring sheet.

7. A switch according to claim 1, wherein the structure is a casing.

8. A switch according to claim 7, wherein the casing is formed of a sheet metal.

9. An electronic device comprising the switch according to claim 1.

* * * * *